US005467067A

United States Patent [19]

Field et al.

[11] Patent Number: 5,467,067

[45] Date of Patent: Nov. 14, 1995

[54] THERMALLY ACTUATED MICROMACHINED MICROWAVE SWITCH

[75] Inventors: Leslie A. Field, Portola Valley; Richard C. Ruby, Menlo Park, both of Calif.

[73] Assignee: Hewlett-Packard Company, Palo Alto, Calif.

[21] Appl. No.: 212,544

[22] Filed: Mar. 14, 1994

[51] Int. Cl.[6] ..... H01H 53/00

[52] U.S. Cl. ..... 335/4; 333/104; 333/262

[58] Field of Search ..... 333/104, 246, 333/262; 335/78–86, 124, 128, 4–5; 200/512

[56] References Cited

U.S. PATENT DOCUMENTS

| | | | |
|---|---|---|---|
| 4,997,521 | 3/1991 | Howe et al. | 156/651 |
| 5,047,740 | 9/1991 | Alman . | |
| 5,069,419 | 12/1991 | Jerman . | |
| 5,121,089 | 6/1992 | Larson . | |
| 5,374,792 | 12/1994 | Ghezzo et al. | 200/16 B |
| 5,386,115 | 1/1995 | Freidhoff et al. | 250/281 |

OTHER PUBLICATIONS

Guckel, H. et al., "Thermo–Magnetic Metal Flexure Actuators," *Technical Digest IEEE Solid–State Sensor and Actuator Workshop,* 0–7803–0456–X/92, 1992, pp. 73–75.

Hackett, R. H. et al., "The Integration of Micro–Machine Fabrication with Electronic Device Fabrication on III–V Semiconductor Materials,"*Transducers '91, International Conference on Solid–State Sensors and Actuators,* 91CH2817–5, 1991, pp. 51–54.

Larson, Lawrence E. et al., "Microactuators for GaAs–Based Microwave Integrated Circuits," *Transducers '91, International Conference on Solid–State Sensors and Actuators,* 91CH2817–5, 1991, pp. 743–746.

*Primary Examiner*—Lincoln Donovan

[57] ABSTRACT

An integration of a micromachined actuator and a signal transmission structure includes a thermal actuator on a side of a displaceable signal line opposite to a fixed signal line. The actuator includes first and second legs. The first leg has a cross-sectional area greater than the second leg, providing a differential in electrical resistance. As current is channeled through the legs, the second leg will elongate more and will deflect both of the legs. The deflection is in a direction to press the displaceable signal line into signal communication with the fixed signal line. Optionally, a thermally operated reset actuator can be positioned to provide a mechanical return of the displaceable signal line. In a preferred embodiment, a microwave transmission environment is provided.

18 Claims, 4 Drawing Sheets

THERMALLY ACTUATED MICROMACHINED MICROWAVE SWITCH

TECHNICAL FIELD

The present invention relates generally to mechanical switches and more particularly to devices for switching of electrical signals.

BACKGROUND ART

Conventionally, electrical switching is utilized to enable and disable a signal path along an integrated circuit chip. For example, diode switches may be employed for electrically triggering signal communication along a signal path on a semiconductor substrate.

As an alternative to semiconductor electronic components, mechanical switches are available even at a miniature level. U.S. Pat. No. 5,047,740 to Alman describes a miniature switch for controlling microwave signal transmission. A spring-loaded mechanism is controlled by a magnetic solenoid to connect a first microwave signal line to either a second or a third microwave signal line. Solenoid activation pivots an armature which determines the positioning of jumpers relative to the microwave signal lines.

U.S. Pat. No. 5,121,089 to Larson describes a micromachined rotary switch that is electrostatically actuated. The rotary switch is fabricated on an integrated circuit wafer using integrated circuit fabrication processing. Microwave transmission lines are positioned to contact a rotating blade of the switch when the rotating blade is properly aligned. Rotation of the blade is controlled by electrostatic fields created by control pads and other switch elements formed on a substrate that also contains the microwave transmission lines.

In a paper entitled "Thermo-Magnetic Metal Flexure Actuators," 0-7803-0456-X/92, 1992 IEEE, Guckel et al. of the University of Wisconsin described an actuator that utilizes one or both of thermal effects and magnetic forces to cause deflection of beams when an electrical current is applied. While this structure functions well in certain applications, there are difficulties. For example, if the Guckel et al. actuator were to be used as a switch to conduct a signal from the beams to a structure that contacts the beams following deflection, signal transmission would be susceptible to feed-through of the actuator-deflection current into the signal transmission. Another difficulty involves inconsistent and even conflicting design requirements for different components of a transmission scheme. A signal line design requires the selection of materials and dimensions to yield a suitable impedance and to minimize signal loss. On the other hand, the actuator of Guckel et al. is designed to achieve a desired deflection in a reliable and efficient manner.

The previously identified patent to Alman lists a number of concerns in the design of a micromachined switch. The switch must be non-particulating and must be adjustable to compensate for changes in the forces which initiate the switching, e.g. magnetic forces. Also, the switch must be reliable over many switching cycles.

What is needed is an integration of a signal transmission scheme and a switching mechanism, wherein compromises between fabrication of the transmission scheme and fabrication and operation of the switching mechanism are minimized.

SUMMARY OF THE INVENTION

The present invention provides an integration of a micromachined actuator and a signal transmission structure that achieves an isolation of operations, so that the transmission structure and the switching structure can each be designed and fabricated to optimize properties specific to the structure. This is particularly important in microwave applications, since microwave transmission requires a suitable environment.

The integration is preferably fabricated on a semiconductor substrate. Standard photolithographic techniques may be employed. The signal transmission structure includes a first signal line that is fixed in place on a surface of the substrate. A second signal line is displaceable with respect to the first signal line. The second signal line may be stationary other than at an end that is adjacent to the first signal line. The displaceable end could then act as an input/output site having a coupled position for signal communication with the first signal line and having a decoupled position in which the first and second signal lines are isolated. In a microwave switching application, the signal lines are fabricated to minimize signal loss and to achieve a desired impedance, e.g., 50 ohms.

A micromachined actuator that is thermally actuated is formed on the substrate surface to selectively switch the second signal line between the coupled and decoupled positions. In a preferred embodiment, the micromachined actuator is on a side of the second signal line opposite to the first signal line. The actuator includes first and second legs having different cross-sectional areas. The actuator is activated by conducting current through the first and second legs. The legs are sufficiently different with respect to cross-sectional dimensions to ensure that the electrical resistance of the first leg is significantly less than that of the second. The conduction of current through the legs causes the micromachined actuator to deflect as the second leg rises in temperature and thermally expands more than the first leg. In a simplest configuration, the legs are parallel to the substrate surface and to each other and are joined together at ends by a conductive bridge. The second leg will undergo a greater increase in temperature for a given electrical current than will the first leg, causing the second leg to expand a greater degree than the first leg. The second leg acts as a working member to deflect the device in the direction of the second signal line to couple the two lines. Disabling current flow through the two legs allows the device to cool and to return to a relaxed position. The second signal line also has a relaxed condition in which the lines are decoupled.

In an alternative embodiment, the relaxed condition of the second signal line is one in which the two lines are in electrical communication. That is, the lines may be formed to be normally closed, rather than normally open. In this embodiment, the thermally actuated micromachined actuator is positioned on the substrate to deflect in a manner to separate the second signal line from the first signal line.

In another embodiment, the integration includes a second micromachined actuator with third and fourth legs having different cross-sectional areas. The two actuators may be placed on opposite sides of the second signal line, with one device operating as a reset mechanism to provide a positive break to return the second signal line to the relaxed position. The use of a reset mechanism prevents the signal lines from cold welding closed, as sometimes happens with microminiature structures. Ideally, the second signal line is brought into contact with a grounded line when not in contact with a first signal line, thereby achieving an increase in signal isolation.

A dielectric material may be deposited on the side of the legs of the thermally actuated switch or on the side of the second signal line to prevent feed-through of the actuating signal of the switch to the signal lines.

An advantage of the present invention is that the signal transmission structure may be optimized for microwave applications, while the switching structure may be concurrently designed and fabricated to achieve desired mechanical characteristics. The second signal line may be made of electroplated gold over polyimide, undercut at the end to allow the end to move into contact with the stationary, first signal line. These materials have sufficiently low Young's moduli to allow the displacement, and the materials permit 50 ohm terminations for microwave applications. The actuator should be made of a material having high Young's modulus. For example, the actuator may be made of nickel to ensure proper operation with a gold/polyimide displaceable second signal line. Nickel provides the desired relationship of Young's moduli and is compatible with known micromachining techniques. However, none of these materials is critical.

By using micromachining techniques to fabricate the switches, switch matrices may be fabricated at a low cost and with a high degree of integration with circuitry for transmitting and processing electrical signals. The switches are integratable with standard processing for such circuitry.

BEST MODE FOR CARRYING OUT THE INVENTION

Figure 1:
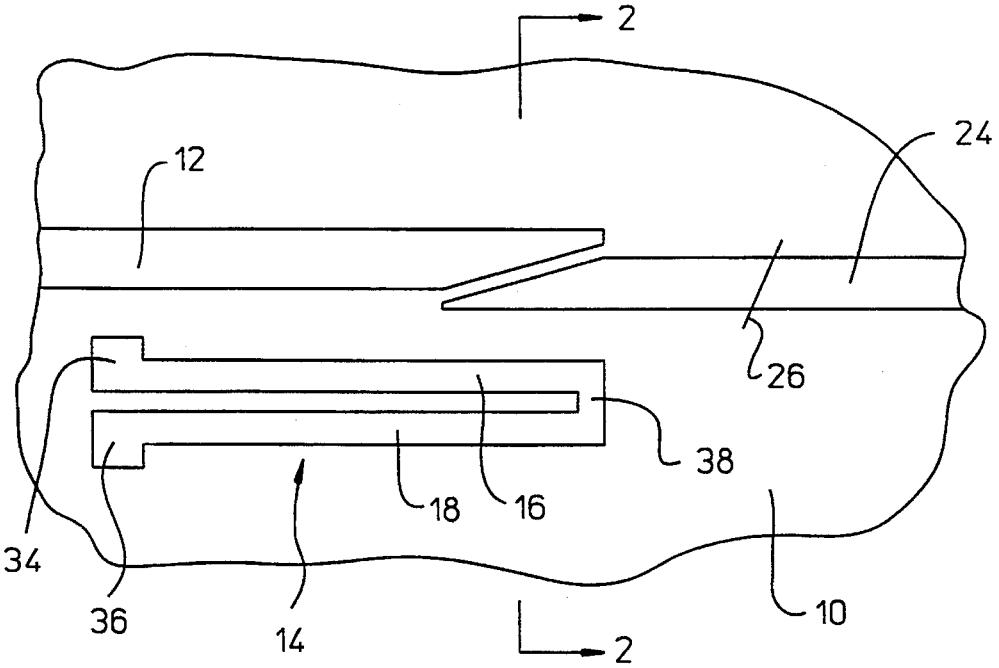
FIG. 1 is a top view of a semiconductor substrate having an integration of a signal transmission structure and a micromachined actuator in accordance with the present invention.
Figure 2:
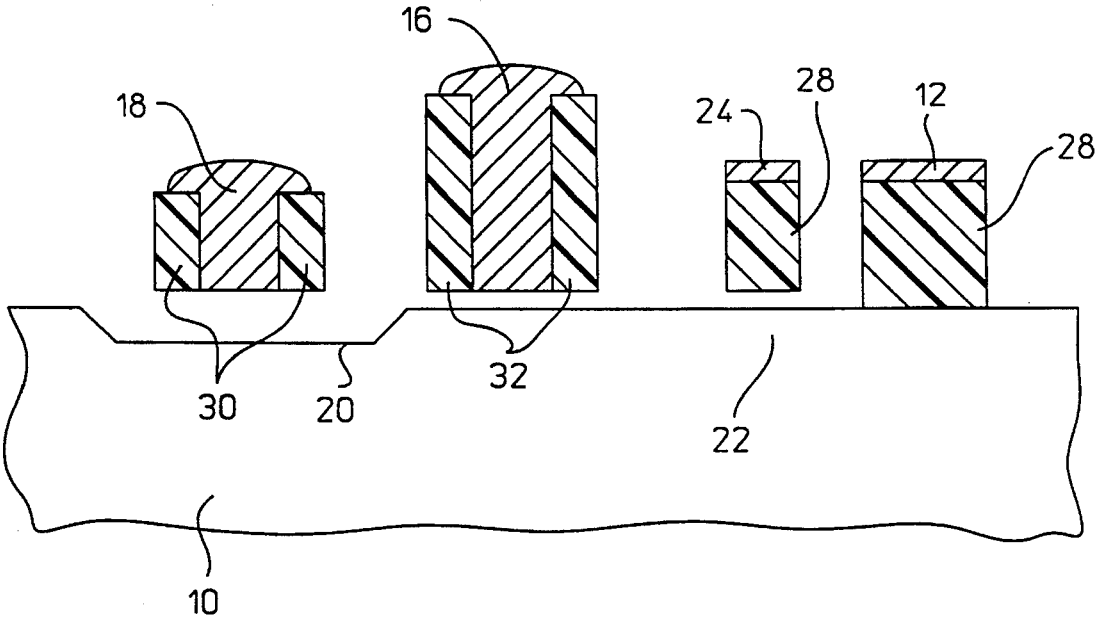
FIG. 2 is a cross-sectional view of the semiconductor wafer of FIG. 1 taken along lines 2—2.

With reference to FIGS. 1 and 2, a semiconductor wafer 10 is shown as supporting a stationary transmission line 12. In a preferred embodiment, a microwave transmission environment is created for low signal loss in conducting microwave signals along the semiconductor substrate 10. For example, ground traces may be added to establish a coplanar structure having a characteristic impedance of 50 ohms. The choice of materials and the width of the stationary transmission line 12 is also important in establishing the desired embodiment, as well understood by a person of ordinary skill in the art.

A micromachined actuator 14 includes a first leg 16 and a second leg 18. Typically, micromachined actuators are fabricated on silicon substrates, since silicon provides excellent mechanical characteristics. However, a gallium arsenide substrate may be preferred for microwave applications. The use of a gallium arsenide substrate requires no unusual etchants or fabrication procedures, since the semiconductor substrate of the present invention need not be shaped in any special manner. Other substrates may be used. For example, alumina substrates are often employed in monolithic microwave integrated circuit (MMIC) devices. The selection of a substrate material is independent of the switching approach of the present invention.

While the substrate 10 is shown as having a trench 20 below the second leg 18, the trench is not critical. That is, substrate 10 may remain generally planar. Signal transmission and switch actuation current can be carried on in surface layers of plated and spun-on materials, and sacrificial and masking layers may be made of plasma-deposited and spun-on materials. The use of a semi-insulating germanium arsenide substrate also allows integration of the micromachined actuator 14 with other components, such as field effect transistors. However, the gallium arsenide substitutes are more fragile than silicon substrates and may increase the fabrication costs.

A second transmission line 24 is undercut at an end extending beyond line 26 in FIG. 1. As shown in FIG. 2, the undercutting extends under the second transmission line so as to space the second transmission line from the substrate. As will be explained below, fabrication of the structure of FIG. 2 includes detaching the first leg 16 from the substrate to allow free movement of the first leg relative to the substrate.

Both the stationary transmission line 12 and the displaceable transmission line 24 are made of electroplated gold atop a dielectric layer 28. The dielectric layer 28 is preferably polyimide, but the use of polyimide presents a problem. Typically, KOH is used as the etchant for forming the trench 20 in the semiconductor wafer 10. However, KOH etches polyimide. One solution is to form the second transmission line to be self-supporting, so that the polyimide can be removed during the trenching of the wafer. Another solution is to substitute a dielectric material that maintains the desired Young's moduli relationship, but that is not removed during the KOH etching steps. A laminated dry film resist may be an acceptable substitute. Likewise, the etchant can be substituted. Yet another solution is merely to eliminate the steps which form trenches, so that the legs 16 and 18 and the polyimide layer 28 slide above the untrenched surface of the wafer. However, greater separations between the legs and the substrate are desired because the separations provide thermal isolation. For example, the trench 20 thermally isolates the second leg 18 from the substrate 10 to increase the efficiency of the micromachined actuator 14. Other materials may be utilized, but the materials and the dimensions of the transmission lines must be designed to achieve the desired transmission environment. An important consideration is that the structure of the second transmission line must be such that the micromachined actuator 14 is able to readily displace the transmission line. Thus, the Young's moduli of the materials is an important consideration.

The transmission lines 12 and 24 are schematically shown as being shaped at the connecting ends. The indicated tapering provides a more signal-transparent connection at microwave frequencies. That is, discontinuity is decreased, so that signal reflection is reduced.

Each of the legs 16 and 18 of the micromachined actuator 14 is formed of electroplated nickel. As shown in FIG. 2, the geometries of at least portions of the two legs are different. The first leg 16 is significantly greater in height than the second leg 18. Each of the two legs is sandwiched between dielectric strips 30 and 32, but the strips are not critical. Moreover, the shape of the dielectric material can be different than the embodiment shown in FIG. 2. For example, the dielectric may coat the top surface of the actuator. What is important to optimal operation of the switching arrangement is the inclusion of some structure to prevent transmission of the actuation signal from a leg to the transmission lines. In the embodiment of FIG. 2, the strip 32 prevents direct contact between the leg 16 and the transmission line 24.

In a relaxed condition, the legs extend parallel to each other and to the upper surface of the semiconductor substrate 10. Each leg has an input/output pad 34 and 36 at one end. At the opposite end, the legs are connected by a bridge 38. In the preferred embodiment, the bridge is also formed of electroplated nickel.

In operation, a source of an actuation current is connected to the input/output pads 34 and 36 to initiate current flow through the first and second legs 16 and 18. Because at least a portion of the first leg 16 has a greater cross-sectional area than the second leg 18, the first leg has a lower electrical resistance than the second leg. When a current is passed through the first and second legs, the second leg 18 will undergo a greater temperature change than the first leg, creating a differential of thermal expansion.

As the second leg 18 expands to a greater degree than the first 16, the resulting differences in the two lengths ($\Delta L$) will cause the micromachined device 14 to deflect at the bridge 38 end. The deflection will be in a counterclockwise direction to contact the movable end of the second transmission line 24. Further deflection brings the second transmission line into signal communication with the stationary transmission line 12. Optionally, a structure for preventing direct contact between the transmission lines can be incorporated. For example, a mechanical stop may be formed to prevent the transmission lines from touching during actuation. The mechanical stop can be a separate feature on the semiconductor substrate 10 or can be in the form of an insulative bumper built up on one of the two transmission lines. The mechanical stop should be disposed to define a fixed gap between the transmission lines when the micromachined device 14 is fully actuated, wherein the fixed gap inhibits transmission of signals below a given frequency.

For a given $\Delta L$, i.e. the difference in the two lengths of the legs due to a temperature differential, the amount of deflection of the micromachined device 14 is proportional to the original lengths of the legs. Each leg may have a length of 4800 μm. Optionally, the second leg 18 may have a length greater than that of the first leg 16, with the second leg meandering or arcing to direct contact with the first leg.

There is an inverse relationship of the gap between the two legs 16 and 18 and the deflection of the device 14 resulting from the difference in thermal expansions of the legs. An acceptable gap is 120 μm, but this dimension is not critical to operation.

There are a number of constraints in the design of the restoring first leg 16 and the working second leg 18. As previously noted, the necessary temperature differential between the two legs is achieved by forming the working leg 18 to have a cross-sectional area that is less than the cross-sectional area of the restoring leg 16. The difference in cross-sectional dimensions ensures that the electrical resistance of the restoring leg is sufficiently less than that of the working leg. In the above-referenced paper authored by Guckel et al. of the University of Wisconsin, this was met by widening a restoring member relative to a working member. While this approach creates the desired area ratio to achieve a higher temperature in the working member with the conduction of electrical current, the approach has the drawback of rendering the restoring member considerably stiffer than the working member. Consequently, the working member of Guckel et al. was formed such that a "buckling" or Euler force of the member was approached. At least to some extent, the concern that the buckling force would be reached was avoided by reducing the width of the restoring member at some distance from the end of the device.

It has been discovered that a preferred configuration for increasing the flexibility of the restoring first leg 16 is one in which the working second leg 18 is actually wider than the restoring leg. While this is contrary to the goal of forming a working leg having a resistance greater than the resistance of the restoring leg, a favorable ratio of cross-sectional areas can be achieved by providing a greater height of the restoring leg relative to the working leg. That is, it is possible to maximize the flexibility, or compliance, of the restoring leg with respect to the working leg by increasing the width of the working leg, while still providing the desired relative resistances. The electrical resistance of the working leg increases only linearly with increasing width, but the relative stiffness increases cubically. How these constraints dictate the relative dimensions can be best seen by an example. If the desired relative ratio of resistances is 2:1, the restoring leg could have a cross-sectional area that is twice the cross-sectional area of the working leg. If it is desirable that the flexibility of the restoring leg 16 be two times greater than the working leg 18, a solution would be one in which the working leg is twice as wide as the restoring leg, but only 25% as tall as the restoring leg.

As the first leg 16 is deflected by the working second leg 18, the first leg exerts a restoring force that is proportional to each of the amount of deflection, the moment of inertia in the direction of displacement of the first leg 16, and the Young's modulus. As previously noted, the moment of inertia has a $HW^3$ dependence, where H is the height of the first leg and W is the width. In one embodiment, the first leg has a height in the range of 25 μm to 50 μm and the second leg has a height that is approximately 50 % of that of the first leg. The width of each leg may be approximately 240 μm. However, persons of ordinary skill in the art will readily understand that these dimensions are not critical and may vary dependent upon the desired application and the above-stated constraints.

As will be explained more fully below, the differential in thermal expansion can also be achieved by having one leg that is wider than the other leg. However, since the moment of inertia provides a $HW^3$ dependence, the restoring force is greater for a micromachined device having legs that are different with respect to cross-sectional area because of a difference in width. Thus, it is preferred that the legs vary in height.

As shown in FIG. 2, a trench 20 is formed below the second leg 18. The trench below the second, or "hotter," leg reduces the amount of thermal energy that escapes into the substrate 10. As described above, the trench is not critical to operation of the invention. At least in embodiments without trenches, a possible concern is that the legs not have a major downward component of force during deflection. One technique to possibly reduce this concern is to introduce a small amount of upward out-of-plane motion into the actuation. This is effected in FIG. 2 by fabricating the legs 16 and 18 to have a mushroom configuration. That is, there is more material at the top of each leg than at the bottom. Consequently, the legs will be cooler at the top than at the bottom. This achieves the desired component of motion in the upward direction.

Figure 3:
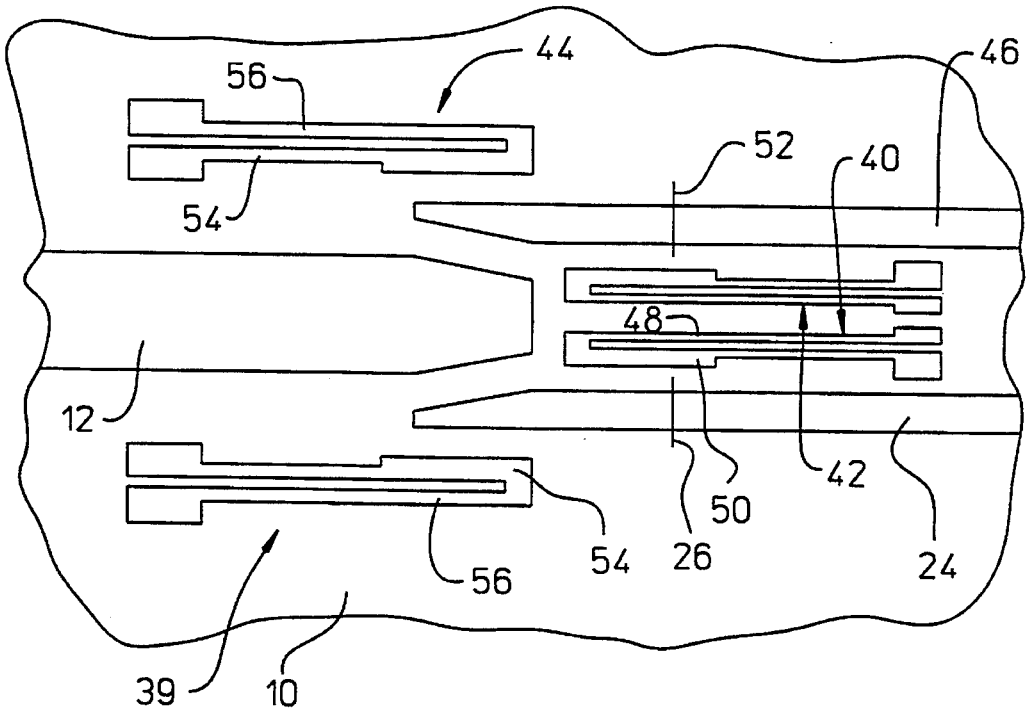
FIG. 3 is a top view of a second embodiment of an integration of a signal transmission structure and a micromachined actuator in accordance with the present invention.

Referring now to FIG. 3, in addition to the transmission lines 12 and 24 and a micromachined device 39, additional thermally actuated switches 40, 42 and 44 and a third transmission line 46 may be fabricated on the semiconductor substrate 10. The switch 40 is positioned to reset the above-described displaceable transmission line 24. Actuation of the switch 40 provides a positive break in the contact of the two transmission lines 12 and 24. Thus, cold welding, which can be a problem in microminiature switching, is prevented. The reset switch 40 can be smaller than the device 39, since the force required to open the contact is not as great as the force required to move the displaceable transmission line 24 from its relaxed condition. Up to five grams of force may be required to bring the transmission line 24 into reproducible electrical communication with the stationary line 12, while significantly less force is required to break the contact. If the transmission lines are chemically clean gold, the break force may be one-half the contact force, or less.

Alternatively, to reduce the risk of cold welding of one transmission line to another transmission line, the lines may be formed of different conductive materials. In this case, since transmission lines formed of dissimilar materials are less likely to be cold welded together, the potential benefit of a reset switch would be reduced.

The reset switch 40 is shown as having a working leg 48 that is narrower than a section of leg 50 that is adjacent to the transmission line 24. Because the working leg presents an electrical resistance greater than that of the outer portion of the leg 50, the working leg will undergo a greater degree of thermal expansion. As the working leg expands to a greater extent than the wider leg 50, the outer portion of the switch 40 will rotate in a counterclockwise direction to break the contact of the transmission line 24 against the stationary transmission line 12. Optionally, the legs of the switch 40 may be equal in width but different in height, such as described with reference to the micromachined actuator 14 of FIGS. 1 and 2.

The third transmission line 46 can be undercut at an end beyond line 52, in the same manner that the transmission line 24 is undercut beyond line 26. The switches 39 and 44 operate in the same manner as the micromachined switch 40, except that legs 54 and 56 of switch 44 are dimensioned to cause the end of the switch to rotate in a clockwise direction, rather than a counterclockwise direction. Likewise, a reset switch 42 rotates in a clockwise direction to prevent any cold welding of the third transmission line 46 against the stationary transmission line 12.

Figure 4:
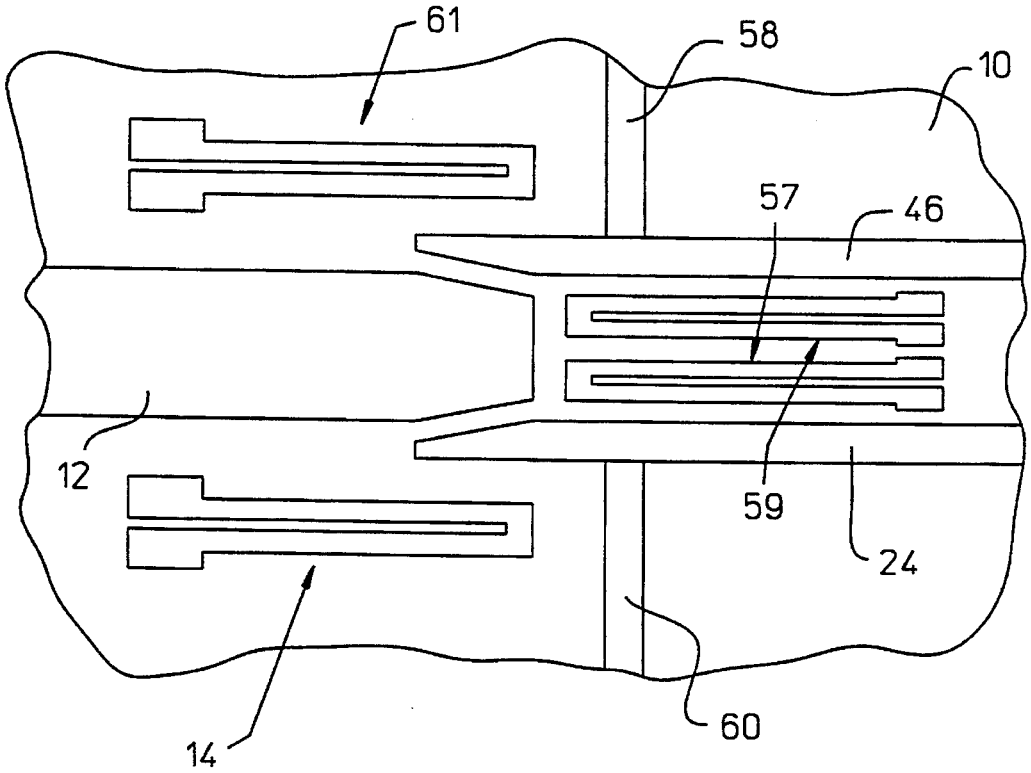
FIG. 4 is a top view of a third embodiment of an integration of a signal transmission structure and a micromachined actuator.

In FIG. 4, two ground lines 58 and 60 have been added to the semiconductor substrate 10. In this embodiment, reset switch actuators 57 and 59 displace the transmission lines 24 and 46 to contact the ground lines 58 and 60. An inactive transmission line can then be selectively grounded in order to increase signal isolation. Each of the switch actuators 14, 57, 59 and 61 has a pair of legs that are equal in width, but at least portions of the two legs of each actuator are different in thickness to achieve the operation described above with reference to FIGS. 1 and 2. The ground lines have a length that brings the ground lines into contact with the transmission lines 24 and 46 when in the relaxed condition of FIG. 4.

Figure 5:
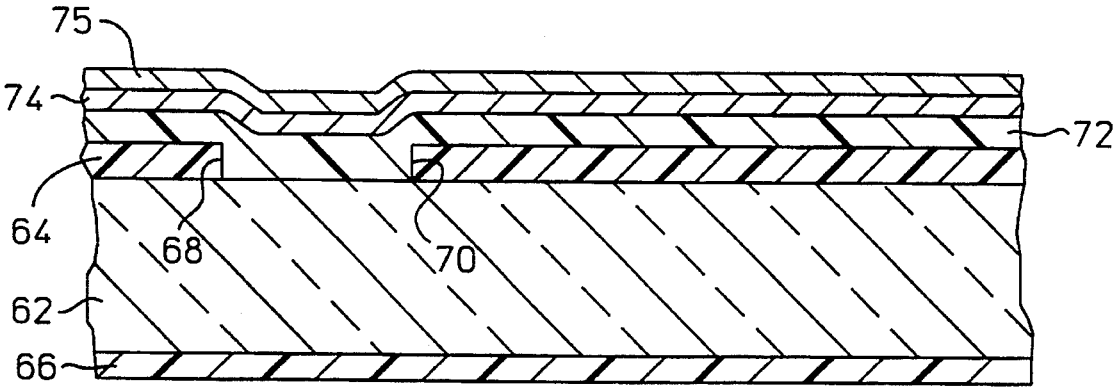
FIGS. 5–9 are side sectional views of steps of one process for fabricating a micromachined actuator in accordance with the present invention.

FIG. 5 illustrates preliminary steps in fabricating a thermally actuated switch on a semiconductor substrate 62. While the processing will be described with reference to a silicon wafer, the wafer may also be a gallium arsenide wafer, with only minor processing changes that are readily understood by persons skilled in the art.

Low-stress silicon nitride layers 64 and 66 are deposited on opposed sides of the substrate 62. A stoichiometric nitride also may be used as the layers 64 and 66. Low pressure chemical vapor deposition may be utilized. An acceptable thickness of the silicon nitride is 800 Å. A low-stress material is preferred in order to minimize lateral undercutting during subsequent etching steps, but a low-stress material is not critical.

Photolithographic techniques are then employed to pattern a photoresistive layer so that a portion of the silicon nitride layer 64 can be etched away to form an opening between sidewalls 68 and 70. For example, a photoresist may be spun onto the unetched layer 64, and then exposed. Conventional developing and etching steps may then be employed to pattern the photoresist and the silicon nitride layer 64. The photoresist is not shown in FIG. 5. A plasma etch at 50 W, 0.025 Torr $O_2$, 0.225 Torr $CF_4$ has been used. The photoresist has been stripped using cold KOH.

A layer 72 of PSG or PECVD oxide is then deposited. An acceptable thickness is 2500 Å. The layer 72 is a sacrificial layer that is selectively removed to expose portions of the substrate 62 for processing steps that may be unrelated to fabrication of the thermally actuated switch actuator or for anchoring the stationary ends of the legs to be fabricated. As previously noted, an important advantage of the present invention is that the switch and the transmission lines can each be fabricated to optimize the different requirements of the structures. In the preferred embodiment, there is an integration of the fabrication steps of forming the transmission lines and the thermally actuated switch, providing planar surfaces for each during fabrication. However, the integration does not significantly inhibit separate optimizations.

Preferably, the sacrificial layer 72 is wet etched in an HF solution that is diluted to 10:1 or in a buffered oxide etch solution at 5:1 dilution. Etching of selected areas is achieved by using a patterned photoresist masking layer, not shown. The resist is then removed. Cold KOH may be used for the resist removal.

Figure 6:
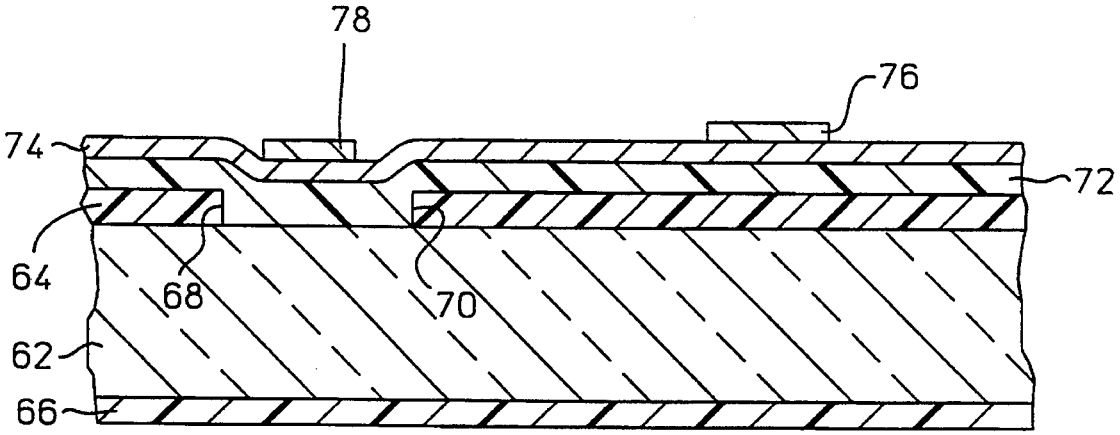

A chromium layer 74 and a nickel layer 75 are then deposited on the substrate 62. Conventional sputtering techniques may be utilized. Photolithographic techniques, including exposing and developing a photoresist which is not shown in FIG. 5, are then used to pattern the Ni layer 75. The Ni layer may be etched in 33% $HNO_3$ in $H_2O$ at 35° C. The resist may be stripped in cold KOH. As seen in FIG. 6, first and second Ni islands 76 and 78 are thereby formed to act as a seed layer for forming the legs of a thermally actuated switch. The unpatterned Cr layer 74 functions firstly as an adhesive film in depositing the Ni layer 75 and can subsequently act as an electrical conductor for establishing the desired electrical potential at the two islands 76 and 78 during the electroplating process for forming the actuator legs.

Figure 7:
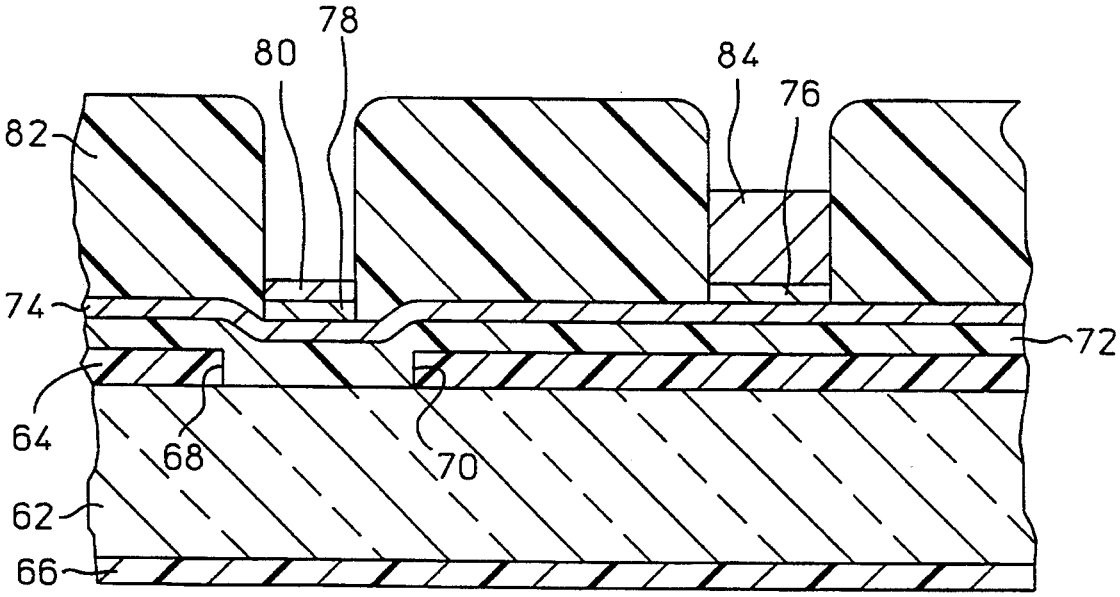

As shown in FIG. 7, a thin layer of PECVD nitride is deposited and patterned to form a cap 80 on the second Ni island 78, so as to prevent nickel from being electroplated on the island. The nitride layer may have a thickness of 5000 Å, but this is not critical. Optionally, a patterned photoresist layer may be used in place of the nitride cap 80.

A thick layer 82 of photoresist, photoimageable polyimide or a dry film resist is then spun or laminated onto the substrate 62 and patterned to cover the substrate other than at regions above the first and second islands 76 and 78. A first electroplating process is utilized to form a portion 84 of a first switch leg on the first island 76.

Figure 8:
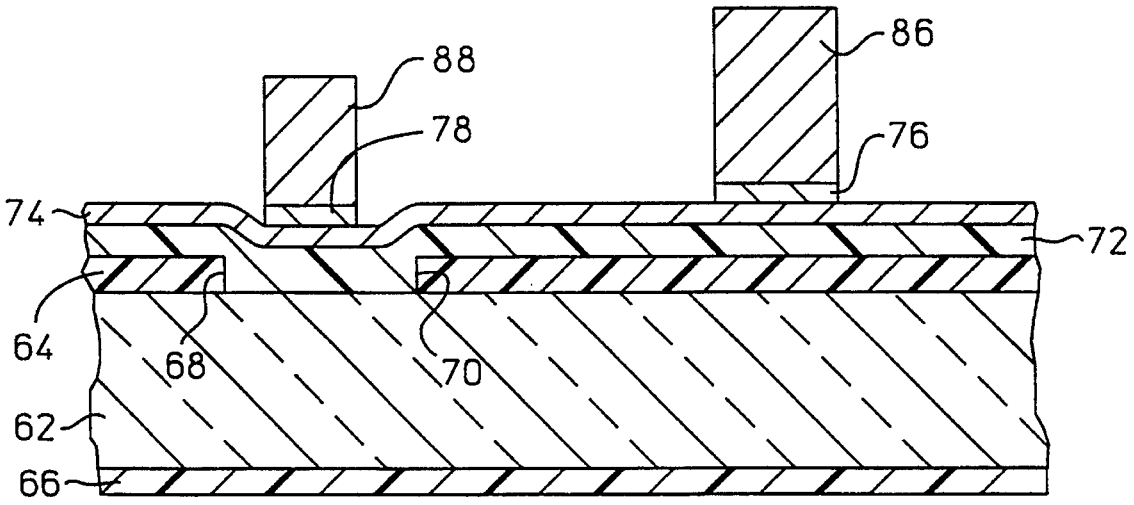
Figure 9:
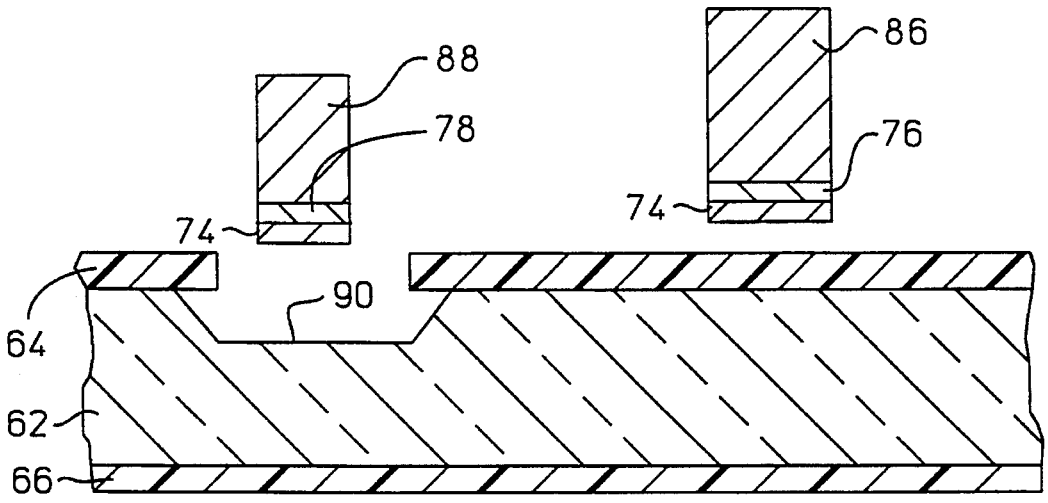

After nickel has been plated on the first island 76, the thin nitride layer 80 is stripped from the second island 78. Referring to FIG. 8, a second electroplating process is then initiated, again using conventional techniques. The combination of the two electroplating steps provides a structure in which a first leg 86 above the first island 76 has a thickness, or height, that is greater than that of a second leg 88 on the second island 78 by an amount equal to the thickness of the nickel 84 shown in FIG. 7. Following the fabrication of the legs, the photoresistive or dielectric material used in confining the legs is removed. Next, the exposed Cr areas are etched to prevent electrical shorting and to allow access to selective etching of the substrate 62, if desired. KOH etching may be employed to form a trench 90 below the "hot" leg 88, as shown in FIG. 9. However, as noted in describing the second transmission line 28 of FIG. 1, the formation of trenches creates a problem, since the KOH will attack polyimide. Solutions are available, but if polyimide is to be used in forming the transmission lines, the preferred embodiment is one in which trenches are not formed.

While the invention has been described primarily with reference to microwave applications, the use of micromachined thermally actuated switches to selectively displace signal lines can be extended to signal environments other than microwave environments.

We claim:

1. An integration of a micromachined device and a signal transmission scheme comprising:

a substrate;

first line means formed on said substrate for conducting an electrical signal;

second line means formed on said substrate for conducting an electrical signal, said second line means having an input/output site having a coupled position for signal communication with said first line means and having a decoupled position in which said first and second line means are isolated with respect to signal communication therebetween; and thermally actuated means, formed on said substrate, for selectively switching said input/output site from one of said coupled and decoupled positions to the other of said coupled and decoupled positions, said thermally actuated means having electrically conductive first and second legs that are sufficiently different with respect to cross-sectional dimensions to effect said switching in response to a differential of thermal expansions of said first and second legs upon the conduction of electrical current therethrough.

2. The integration of claim 1 wherein said substrate and said first and second line means are structured to achieve a microwave transmission environment.

3. The integration of claim 1 wherein said first and second legs are spaced apart from said second line means by a dielectric material to inhibit electrical communication between said second line means and said first and second legs.

4. The integration of claim 1 wherein said first and second legs have a relaxed condition in the absence of said conduction of electrical current, said first and second legs being spaced apart and being generally parallel when in said relaxed condition.

5. The integration of claim 1 wherein said first and second legs are connected at free ends by a bridge at first ends of said first and second legs.

6. The integration of claim 1 wherein said difference with respect to cross-sectional dimensions is one in which said first leg has a height from said substrate that is greater than the height of said second leg.

7. The integration of claim 1 wherein said thermally actuated means is positioned on a surface of said substrate such that deformations of said first and second legs upon said conduction of electrical current are in a direction generally parallel to said surface.

8. The integration of claim 1 wherein said difference in cross-sectional dimensions of said first and second legs is one in which electrical resistance through said first leg is less than electrical resistance through said second leg, wherein the difference in electrical resistance causes said second leg to increase in temperature to a greater extent than said first leg when an equal electrical current is conducted through said first and second legs.

9. The integration of claim 1 wherein said substrate has a trench below said second leg to reduce thermal energy flow from said second leg to said substrate.

10. The integration of claim 1 further comprising a second thermally actuated means having third and fourth legs positioned for selectively displacing said second line means toward said first and second legs in response to current flow through said third and fourth legs, thereby providing a mechanical reset.

11. An integration of a micromachined actuator and a signal transmission structure comprising:

a semiconductor substrate having a first surface;

a first signal line on said first surface;

a displaceable second signal line adjacent to said first signal line on said first surface; and flexible first and second legs electrically and mechanically connected at free ends to form an electrical path for conducting a switching signal through said first and second legs, said first and second legs being on a side of said second signal line opposite to said first signal line, said first and second legs being geometrically incongruent such that the electrical resistance of said first leg is different than the electrical resistance of said second leg, wherein differences in localized heating in response to conducting said switching signal through said first and second legs cause leg deformation in a direction to press said second signal line toward said first signal line.

12. The integration of claim 11 further comprising geometrically incongruent third and fourth legs disposed on said first surface to press said second signal line away from said first signal line in response to conduction of electrical current through said third and fourth legs, said third and fourth legs being fixed to said first surface at first ends and having second ends displaceable with respect to said first surface, said second ends being fixed together.

13. The integration of claim 11 wherein said second signal line contacts a source of ground potential in the absence of conduction of said switching signal through said first and second legs.

14. The integration of claim 11 wherein said first leg has a height greater than that of said second leg.

15. The integration of claim 11 further comprising a trench formed in said substrate under at least one of said first and second legs.

16. The integration of claim 11 further comprising structure on said first surface to form a microwave transmission environment for said first and second signal lines.

17. A method of forming an integration of a micromachined actuator and a signal transmission structure comprising:

providing a substrate;

forming a fixed signal line and a switchable signal line on said substrate, including positioning said switchable signal line to allow movement between a coupled position in signal communication with said fixed signal line and a decoupled position in which said fixed and switchable signal lines are electrically isolated; and forming a thermally actuated switch on said substrate, including forming geometrically incongruent first and second legs such that said legs are each fixed at first ends and electrically connected at free second ends;

wherein forming said first and second legs includes selecting dimensions such that conducting current through said first and second legs causes deformation in a direction to displace said switchable signal line from one of said coupled and decoupled positions to the other of said coupled and decoupled positions.

18. The method of claim 17 wherein forming said first and second legs includes forming a mold for plating at least one metal layer.

* * * * *